US005647273A

United States Patent [19]

Imamaki

[11] Patent Number: 5,647,273

[45] Date of Patent: Jul. 15, 1997

[54] STAMP CARTRIDGE FOR USE IN A STAMP UNIT

[75] Inventor: Teruo Imamaki, Ksugai, Japan

[73] Assignee: Brother Kogyo Kabushiki Kaisha, Nagoya, Japan

[21] Appl. No.: 567,430

[22] Filed: Dec. 5, 1995

[30] Foreign Application Priority Data

Dec. 28, 1994 [JP] Japan ..... 6-339905

[51] Int. Cl.[6] ..... B41N 1/24

[52] U.S. Cl. ..... 101/125; 101/127

[58] Field of Search ..... 101/125, 114, 101/129, 127.1, 128.1, 333, 127

[56] References Cited

U.S. PATENT DOCUMENTS 5,285,725 2/1994 Imamaki et al. ..... 101/127.1

5,463,947 11/1995 Taira ..... 101/125

*Primary Examiner*—Ren Yan

*Assistant Examiner*—Daniel J. Colilla

*Attorney, Agent, or Firm*—Oliff & Berridge

[57] ABSTRACT

A stamp cartridge including a frame, an ink-permeated body, and a heat-sensitive stencil sheet. The frame has a plate and a peripheral wall together defining a first recess to a first side of the plate and a second recess to a second side of the plate. The ink-permeated body is disposed in the second recess so that a surface of the ink-permeated body is framed by the peripheral wall. The heat-sensitive stencil sheet covers the framed surface of the ink-permeated body and an outer periphery of the peripheral wall. A portion of the heat-sensitive stencil sheet is folded into the first recess. A cap member can also be fitted in the first recess to press the portion of the heat-sensitive stencil folded into the first recess against an inner surface of the peripheral wall.

10 Claims, 7 Drawing Sheets

STAMP CARTRIDGE FOR USE IN A STAMP UNIT

BACKGROUND OF THE INVENTION

1. Field of the Invention

The present invention relates to a stamp cartridge utilized in a stencil-type stamp unit.

2. Description of the Related Art

Conventionally, various kinds of stamps with a print face made of rubber have been used for printing company names, addresses, or other kinds of character arrays on the surface of paper sheets. Because these kinds of stamps are usually prepared individually to each order, they are expensive and require a long period from order to delivery.

On the other hand, sheets of heat-sensitive stencil paper have been conventionally perforated using infrared radiation or a thermal head to form a desired pattern in the heat-sensitive sheets. Various patterns such as character trains, figures, or marks can be printed by transmitting ink through the perforation array.

U.S. Pat. No. 5,285,725 describes a stencil plate, or stamp cartridge, including a heat-sensitive stencil sheet and an ink-permeated body soaked with ink. This stamp cartridge is ideal for making stamps in place of conventional stamps with print faces made of rubber.

The stamp cartridge is assembled in the following way. The ink-permeated body soaked in ink is inserted in a frame so that the frame surrounds the periphery of the ink-permeated body. A synthetic resin film is adhered to one surface of the ink-permeated body and of the frame. The heat-sensitive stencil sheet is adhered to the other surface. A removable film separator may be disposed between the ink-permeated body and the stencil plate.

The stamp cartridge is attached, via a cushion material, to the lower surface of a stamp member, which includes a grip. The desired character train or other pattern is perforated in the heat-sensitive stencil sheet using infrared radiation or a thermal head. The resultant stamp includes a stamp member and a stamp cartridge and is capable of printing the desired character train or other pattern described above on sheets many times just like the usual rubber-made stamp. U.S. Pat. No. 5,463,947 describes a stamp cartridge similar to the one described in U.S. Pat. No. 5,285,725.

There also has been known a stamp cartridge 60 shown in FIG. 1. The stamp cartridge 60 includes an ink-permeated body (not shown in the drawings); a rectangular parallelepiped-shaped frame 61 whose top side is opened; and a heat-sensitive stencil sheet 62. The stamp cartridge 60 is assembled by disposing the ink-permeated body to the lower surface on the bottom wall of the frame 61 and attaching the heat-sensitive stencil sheet 62 to the frame 61 so as to cover the outer peripheral surface of the frame 61 from the lower surface of the ink-permeated body.

Adhesive is coated on the heat-sensitive stencil sheet 62. To adhere the heat-sensitive stencil sheet 62 to the outer surface of the peripheral wall of the frame 61, the heat-sensitive stencil sheet 62 is folded appropriately to form flaps 63. Also, the upper edge of the heat-sensitive stencil sheet 62 is aligned with the upper edge of the frame 61 and adhered to the peripheral wall of the frame 61 via the adhesive.

If the heat-sensitive stencil sheet 62 is adhered to the frame 61 as described above, then there is a risk that, while the stamp is being used or while being stored, capillarity may draw the ink impregnating the ink-permeated body upwards between the inner surface of the heat-sensitive stencil sheet 62 and the outer surface of the peripheral wall of the frame 61. This kind of upwardly seeping ink leaks from between the upper edge of the heat-sensitive stencil sheet 62 and the upper edge of the peripheral wall of the frame 61 to the outside of the stamp cartridge 60. As a result, ink can stain the outer surface of the heat-sensitive stencil sheet 62, which leads to staining of the characters or patterns printed by the stamp or to staining the fingers of an operator replacing the stamp cartridge 60.

SUMMARY OF THE INVENTION

It is an objective of the present invention to overcome the above-described problems and to provide a stamp cartridge in which the stamp can be used over a long period of time to print clear characters or patterns without staining the printed characters or patterns, and in which the replacement of cartridges can be done without staining an operator's fingers.

To achieve the above-described objectives, a stamp cartridge according to the present invention includes a frame having a plate and a peripheral wall together defining a first recess to a first side of the plate and a second recess to a second side of the plate; an ink-permeated body disposed in the second recess so that a surface of the ink-permeated body is framed by the peripheral wall; and a heat-sensitive stencil sheet covering the framed surface of the ink-permeated body and an outer periphery of the peripheral wall, a portion of the heat-sensitive stencil sheet folding into the first recess.

According to another aspect of the present invention, a cap member is fitted in the first recess to press the portion of the heat-sensitive stencil folded into the first recess against an inner surface of the peripheral wall.

According to a further aspect of the present invention, an adhesive layer is coated to a predetermined region of the heat-sensitive stencil sheet.

According to a still further aspect of the present invention, a through hole is formed in the heat-sensitive stencil sheet at a position near the predetermined region. Also, the heat-sensitive stencil sheet is folded so that the adhesive layer on a corresponding portion of the heat-sensitive stencil sheet is exposed through the through hole. The exposed adhesive layer adheres the corresponding portion of the heat-sensitive stencil sheet to a portion of the heat-sensitive stencil sheet in contact with the peripheral wall.

BRIEF DESCRIPTION OF THE DRAWINGS

The above and other objects, features and advantages of the invention will become more apparent from reading the following description of the preferred embodiment taken in connection with the accompanying drawings in which:

FIG. 8 (*b*) is an exploded perspective cross-sectional view showing connection between the stamp cartridge and an outer-periphery holding member according to another example.

DETAILED DESCRIPTION OF THE PREFERRED EMBODIMENTS

Figure 1:
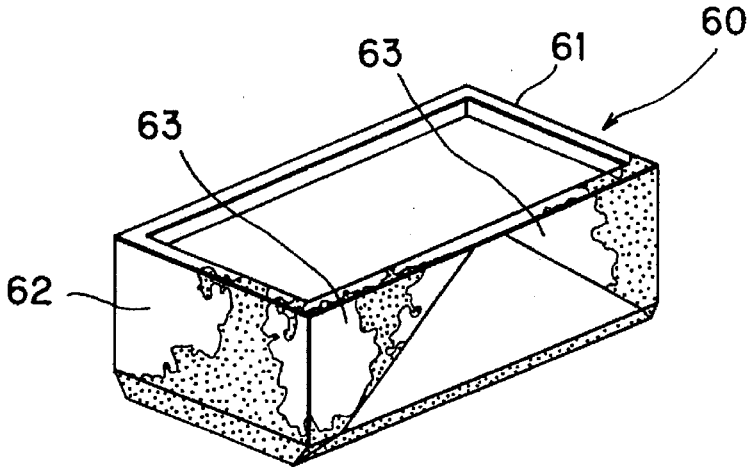
FIG. 1 PRIOR ART
FIG. 1 is a perspective view of a conventional stamp cartridge.

A stamp cartridge of a stamp unit according to a preferred embodiment of the present invention will be described while referring to the accompanying drawings wherein like parts and components are designated by the same reference numerals to avoid duplicating description. Expressions such as "upper," "lower," "right," and "left" are used herein to define the various part when the stamp cartridge and stamp unit are in an orientation in which they are intended to be used.

Figure 2:
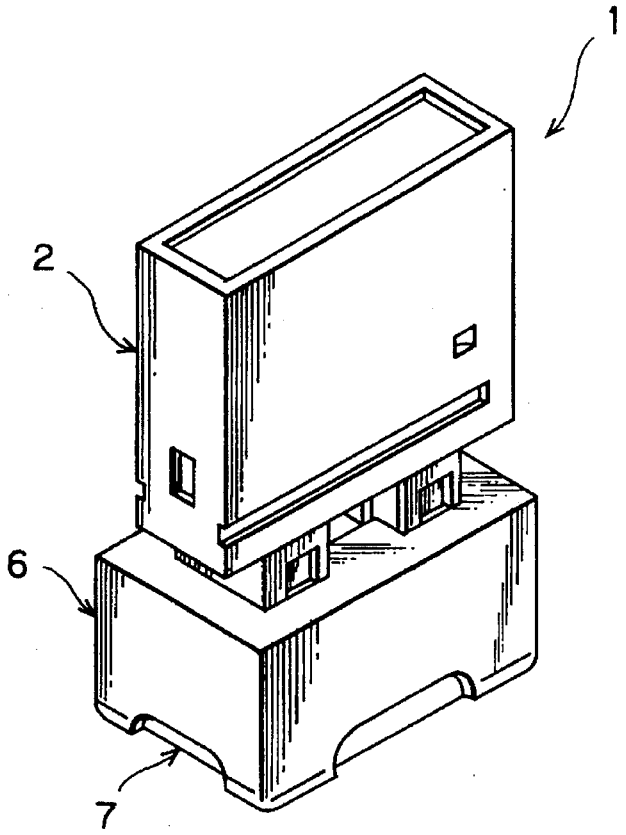
FIG. 2 is a perspective view of a stamp unit in which is used a stamp cartridge according to an embodiment of the present invention.
Figure 3:
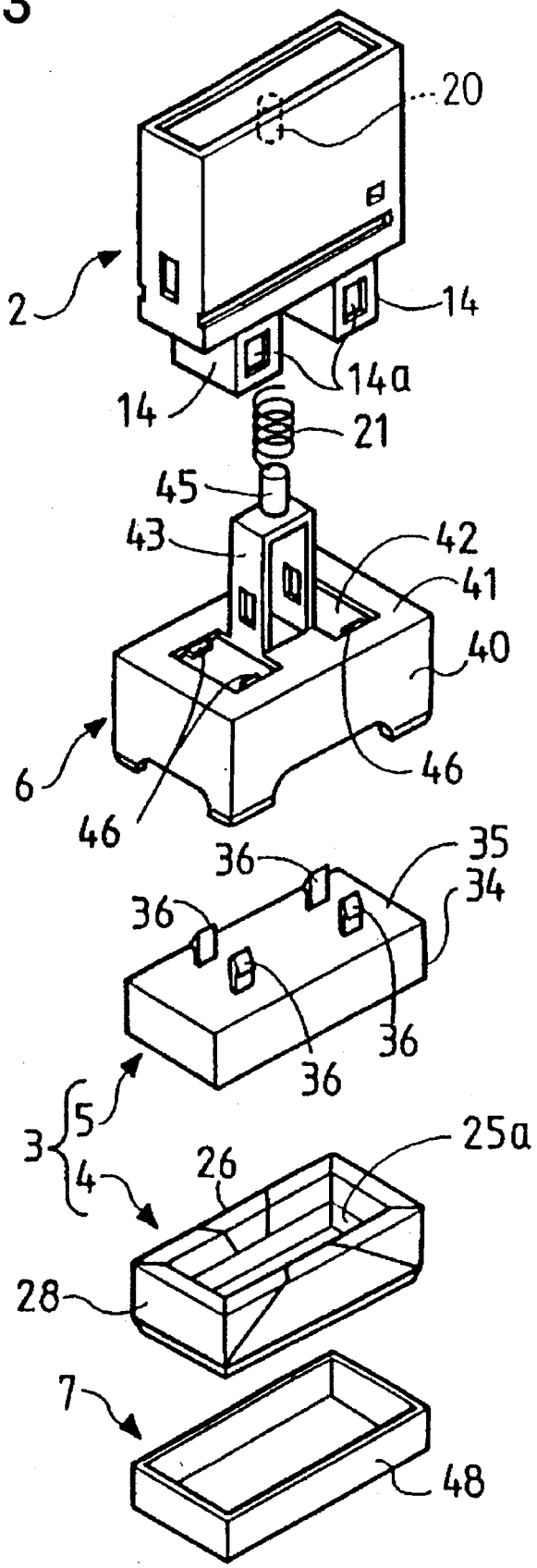
FIG. 3 is an exploded perspective view of the stamp unit.

The present embodiment describes the stamp cartridge of the present invention used in a stamp unit 1 shown in FIGS. 2 and 3. The stamp unit 1 comprises a grip member 2 for grasping by hand, a stamp member 3 fixedly connected to the grip member 2, a skirt member 6 covering the outer periphery of the stamp member 3, and a freely detachable protection cap 7 that fits over the stamp member 3.

Next, the above-described parts of the configuration will be described in greater detail while referring to FIG. 3. The grip member 2 is formed from a metal or synthetic resin material in the shape of a hollow rectangular parallelepiped body whose lower end is opened. A pair of downward projecting right and left foot portions 14 is provided at the lower end portion of the grip member 2. Engaging windows 14*a* are formed in the foot portions 14. A spring support portion 20 is formed in the center portion of the lower surface of the upper wall in the interior of the grip member 2.

Figure 4:
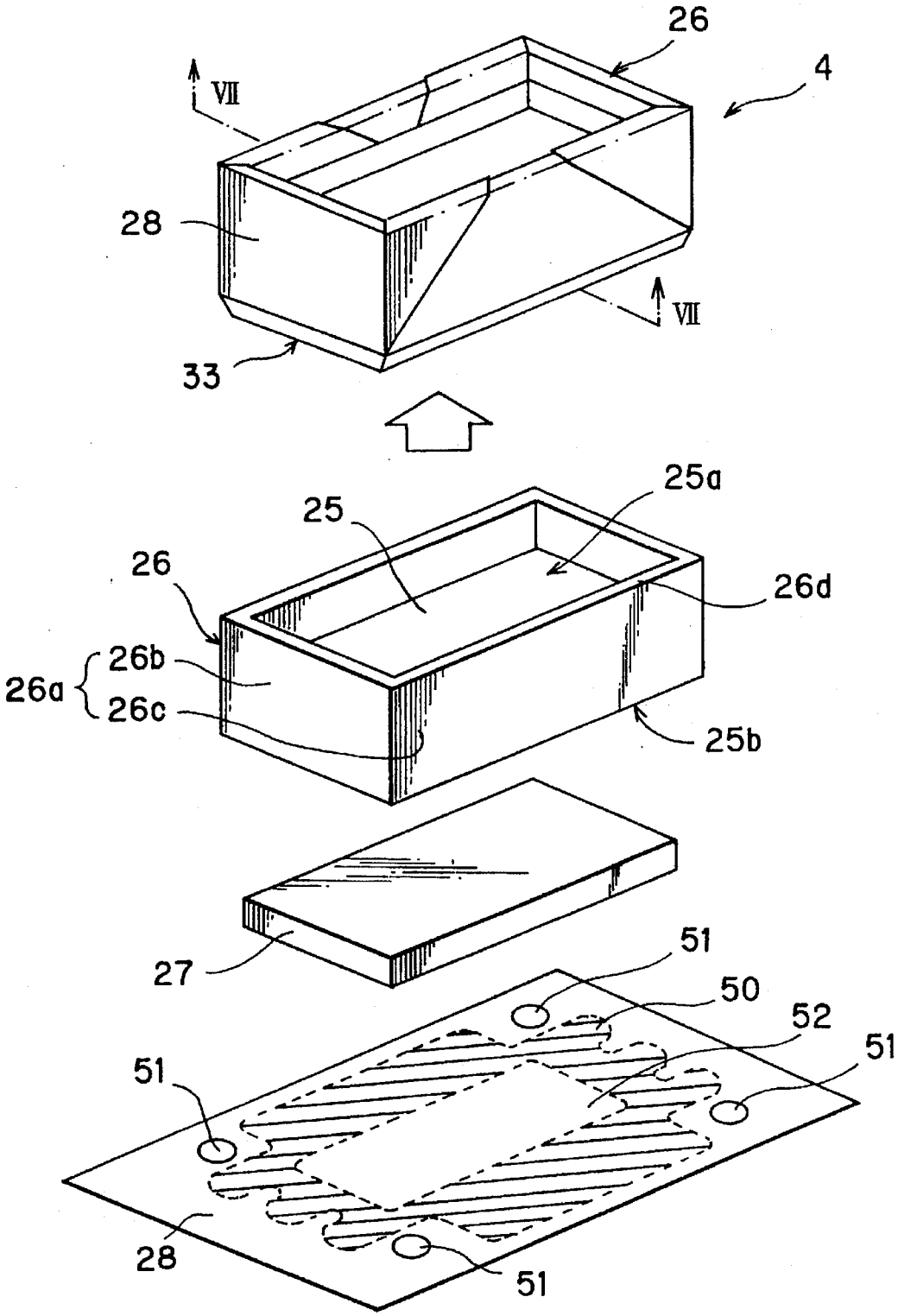
FIG. 4 is an exploded perspective view of the stamp cartridge.

The stamp member 3 includes a stamp cartridge 4 and an outer-periphery holding member 5. As shown in FIG. 4, the stamp cartridge 4 includes a synthetic resin frame 26, which is a rectangular parallelepiped-shaped frame provided with recessed portions 25*a* and 25*b* on its upper and lower sides; an ink-permeated body 27 soaked in an oil-based ink and inserted into the recessed portion 25*b* of the frame 26; and a heat-sensitive stencil sheet 28 covering, in a manner to be described later, the lower surface of the ink-permeated body 27 and the frame 26 as shown in FIG. 4. The ink-permeated body 27 may be attached to the lower surface recessed portion 25*b* of the frame 26 by an adhesive agent or the like. The section of the heat-sensitive stencil sheet 28 at the lower surface of the ink-permeated body 27 serves as the print face portion 33. As described above, the heat-sensitive stencil sheet 28 covers the outer peripheral surface of the frame 26. With this configuration, the print face portion 33 spans over nearly the entire lower surface of the stamp member 3. As a result, positioning during printing is simplified.

Returning to FIG. 3, the outer-periphery holding member 5 includes a rectangular-shaped peripheral wall portion 34 into which the stamp cartridge 4 is inserted and an upper wall portion 35 provided with engaging pawls 36 at positions corresponding to the four engaging windows 14*a* in the foot portions 14 of the grip member 2. Triangular-shaped projections are formed on the outer side of each of the engaging pawls 36. Each triangular-shaped engaging pawl 36 has a downward slanting surface. The engaging pawls 36 are fixed into place by inserting through the inner portion of the skirt member 6 and into engagement with the four engaging windows 14*a* of the grip member 2.

The skirt member 6 includes a rectangular-shaped outer peripheral wall portion 40 into which the outer peripheral wall portion 34 of the outer-periphery holding member 5 is inserted so as to be freely slidable in the vertical direction; an upper wall portion 41 which forms the upper edges of the outer peripheral wall portion 40 and which is located above the upper wall portion 35; a doorway-shape portion 43 which projects from the central portion of the upper wall portion 41 upwards to a predetermined height and which is inserted into the grip member 2; and a spring support portion 45 which projects from the central portion of the upper end of the doorway-shape portion 43. A pair of right and left rectangular holes 42 is formed in the upper wall portion 41 of the skirt member 6 so as to sandwich the doorway-shape portion 43 therebetween. Each of the rectangular holes 42 is provided with triangular-shaped projections 46 to the front and rear of the side portions thereof. The foot portions 14 of the grip member 2 are inserted from above into the rectangular holes 42 so as to freely slide in the vertical direction and so that the projections 46 fit into the engaging windows 14*a* of the foot portions 14. A compression spring 21 urging the grip member 2 upward is mounted between the spring support portion 45 of the skirt member 6 and the spring support portion 20 of the grip member 2. The center portion at the lower edge on all four sides of the outer peripheral wall 40 of the skirt member 6 is cut away to facilitate attachment and detachment of the protection cap 7 and to facilitate positioning during stamp printing.

The protection cap 7 is freely detachable and provided to cover and thereby protect the lower surface of the stamp cartridge 4, that is, to protect the print face portion 33. An outer peripheral wall portion 48 of the protection cap 7 is formed in the same rectangular shape as the outer peripheral wall 34 of the outer-periphery holding member 5. When the protection cap 7 is inserted in the outer peripheral wall section 40 of the skirt member 6 and supported thereby, the upper edge of the protection cap 7 abuts the lower edge of the outer peripheral wall 34, creating a small gap between the protection cap 7 and the print face portion 33. The protection cap 7 is supported by the friction between the outer surface of the outer peripheral wall 48 and the inner surface of the outer peripheral wall 40 of the skirt member 6. Therefore, even if, while the protection cap 7 is mounted, the grip member 2 is pressed downward, the gap is maintained due to the abutment of the upper edge of the protection cap 7 and the lower edge of the outer peripheral wall 34, and consequently, ink does not adhere to the protection cap 7.

To print desired characters or patterns on a sheet using the stamp unit 1 described above, a thermal head of a thermal printer (not shown) is used to perforate the desired characters or patterns in the portion of the heat-sensitive stencil sheet 28 serving as the print face portion 33. Next, the protection cap 7 is detached, and the skirt member 6 is set an the desired position for printing on the surface of the sheet. The print face portion 33 is positioned accurately to the desired printing position by moving the stamp unit 1 while looking at the printing position and the edges of the print face portion 33 through the cut-away sections in the lower edge of the skirt member 6. After positioning the print face portion 33 for printing in this way, the grip member 2 is pressed from above. This pressure pushes the leg portions 14 down on the upper wall portion 35 of the outer-periphery holding member 5 and compresses the spring 21, thereby pressing the stamp member 3 against the printing position and raising the skirt member 6. That is, after using the skirt member 6 to position the print face portion 33 in the desired position on the surface of the sheet, the grip member 2 is grasped and pushed downward, pushing the print face portion 33 onto the surface of the sheet. At this time, the ink-permeated body 27 is squeezed between the frame 26 and the sheet, and the ink in the ink-permeated body 27 seeps through the multiple perforations, printing the perforation pattern on the surface of the sheet. After printing, when the pressure pushing on the grip member 2 is released, the grip member 2 together with the stamp member 3 is urged upward by the compression spring 21 to rise and return to its original position. This return operation speeds up separation of the print face portion 33 from the sheet, so that a clear print is produced even on a thin sheet.

The stamp cartridge 4 utilized in the stamp unit 1 of present embodiment has been devised with measures to prevent ink impregnated in the ink-permeated body 27 from leaking out from the stamp cartridge 4 while the stamp is continually used for printing the characters or patterns or while a replaceable cartridge 4 is being stored. The particular configuration for preventing ink leakage will be described in detail while referring to FIGS. 4 through 8. As described above, the stamp cartridge 4 includes the frame 26, the ink-permeated body 27, and the heat-sensitive sheet 28.

The frame 26 is disposed in contact with the oil-based ink of the ink-permeated body 27, so is made from a synthetic resin material with excellent oil-proof properties (for example, vinyl chloride, polypropylene, polyethylene, polyacetal, or polyethylene terephthalate) or a metal material. The frame 26 includes cross plate 25 and a peripheral wall **26*a*. The peripheral wall 26*a* has widthwise sides 26*b*, lengthwise sides 26*c*, and an upper edge 26*d*. The upper surface recessed portion 25*a* is to one side of cross plate 25 and the lower surface side recessed portion 25*b* is to the opposite side of the cross plate 25. The upper surface recessed portion 25*a* of the frame 26 is defined by an upper surface of the cross plate 25 and an inner surface of the peripheral wall 26*a* between the upper surface of the cross plate 25 and the upper edge 26*d* of the peripheral wall 26*a*. Similarly, the lower surface side recessed portion 25*b* is defined by a lower surface of the cross plate 25 and corresponding inner surface of the peripheral wall 26*a*. The recessed portion 25*b* prevents the ink-permeated body 27 from shifting out of position while the ink-permeated body 27** disposed therein.

The ink-permeated body 27 is made from an elastic foam body or a non-woven fabric. The elastic foam body can be made from synthetic resin materials such as polyethylene, polypropylene, polyethylene terephthalate, polyurethane, and acrylonitrile-butadiene rubber. The ink-permeated body 27 has been soaked to a state of saturation with an oil-based ink so that ink seeps out when pressure is applied to the ink-permeated body 27. The ink-permeated body 27 is disposed recessed portion **25*b* so that the surface of the ink-permeated body corresponding to the print face portion 33** is framed by the peripheral wall.

Figure 5:
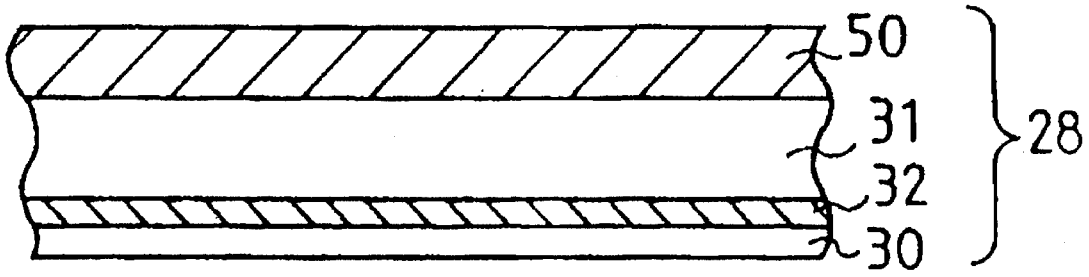
FIG. 5 is an enlarged cross-sectional view of the heat-sensitive stencil sheet used in the stamp cartridge.

As shown in FIG. 5, the heat-sensitive stencil sheet 28 includes a thermoplastic film 30; a porous carrier 31; and an adhesive layer 32 through which the thermoplastic film 30 and the porous carrier 31 are attached to each other. The thermoplastic film 30 is made of a thermoplastic synthetic resin film (for example, polyethylene terephthalate, polypropylene, vinylidene chloride-vinyl chloride copolymer). The thermoplastic film 30 is made with a thickness of 1 to 4 μm, preferably 2 μm because film with a thickness of less than 1 μm has poor physical strength and is expensive to produce, making it unsuitable for practical use, but film with a thickness of 4 μm or greater is too thick to be perforated by a general thermal head with a rated output of about 50 mJ/mm$^2$. The porous carrier 31 is made of a thin sheet of porous paper made primarily of a natural fiber such as Manila hemp, paper mulberry (*Broussonetia kazinoki*), or mitsumata (*Edgeworthia papyrifera*); a synthetic fiber such as polyethylene terephthalate, polyvinyl alcohol, or polyacrylonitrile; or a semi-synthetic fiber such as rayon.

As shown in FIG. 4, an adhesive is precoated to a predetermined region 50 on the heat-sensitive stencil sheet 28. Adhesive is not applied to an area 52 within the predetermined region 50. The area 52 of the heat-sensitive stencil sheet 28 will contact the ink-permeated body 27 and will serve as the print face portion 33. In order to distinguish from the area where adhesive has not been applied, the predetermined region 50 is indicated by hatching in FIGS. 4, 6, and 7. Adhesive is precoated to the predetermined region 50 for fixing the heat-sensitive stencil sheet 28 to the peripheral wall side surface, to the peripheral wall upper edge surface, and to the peripheral wall inner side surface of the frame 26. This adhesive forms a tight seal so that ink from the ink-permeated body 27 will not leak out from between the frame 26 and the heat-sensitive stencil sheet 28. Adhesive is also precoated to the heat-sensitive stencil sheet 28 at inner surfaces thereof for adhering the heat-sensitive stencil sheet 28 to itself to form fold-in flaps A shown in FIG. 6.

Figure 6:
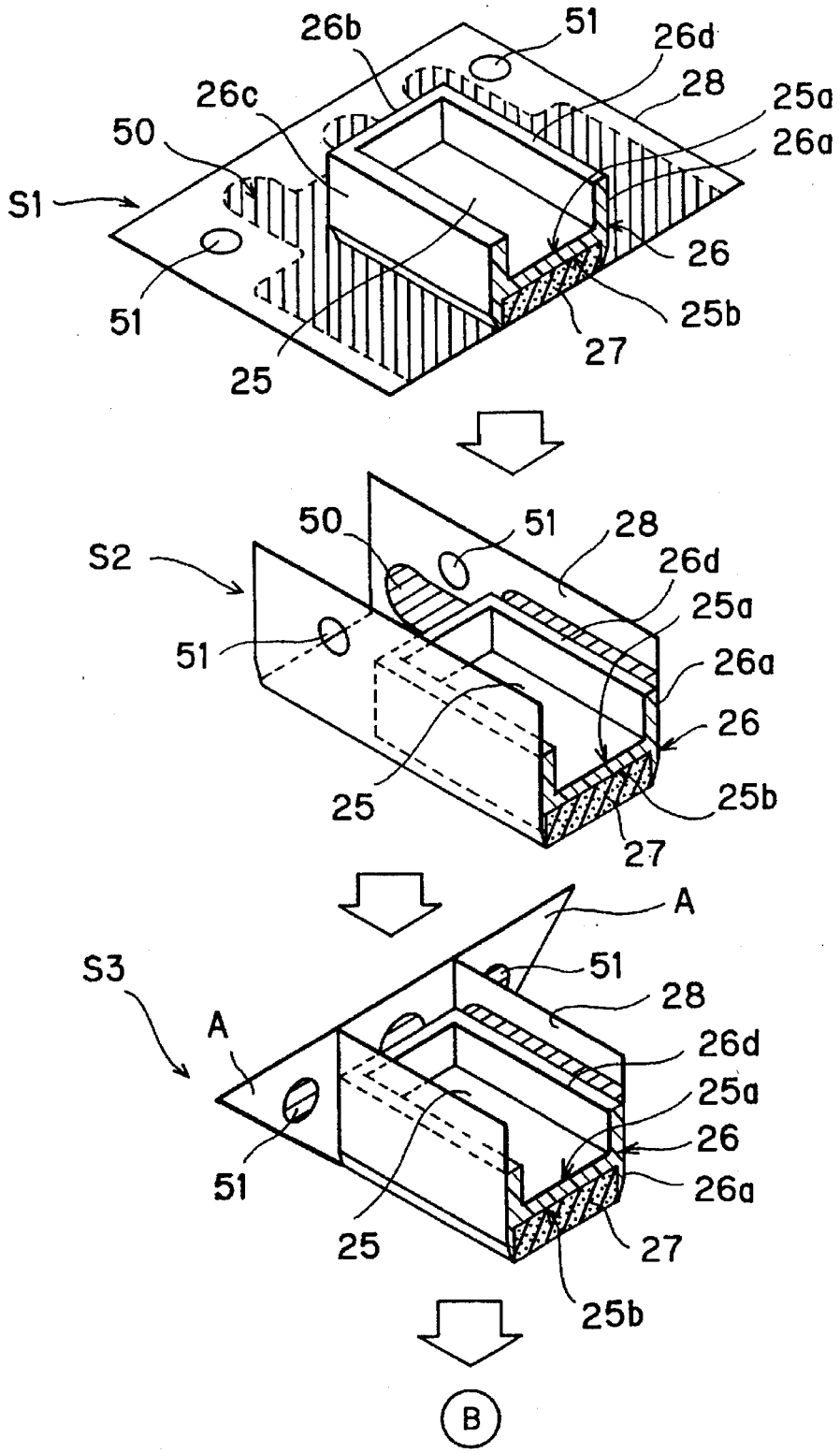
FIG. 6 is a perspective cross-sectional view taken along line X—X of FIG. 4 and illustrating a portion of steps for assembling the stamp cartridge.

Further, as shown in FIG. 4, through holes 51 are preopened near the four corners of the heat-sensitive stencil sheet 28 so that, when the heat-sensitive stencil sheet 28 is folded to form the fold-in flaps A, the through holes 51 will confront the lengthwise side **26*c* of frame 26 as shown in FIG. 6 and some of the adhesive at the predetermined region 50 will be exposed through the through holes 51**.

The method of assembling the stamp cartridge 4 according the present invention, that is, steps for wrapping the heat-sensitive stencil sheet 28 around the frame 26 and fixing the heat-sensitive stencil sheet 28 to the frame 26, will be described while referring to FIGS. 6 and 7.

First, in Step (hereinafter, referred to as "S") 1, the frame 26 is placed on top of the heat-sensitive stencil sheet 28 so that the ink-permeated body 27 inserted into the lower surface side recessed portion **25*b* of the frame 26 is positioned in the area 52**.

In S2, the heat-sensitive stencil sheet 28 is folded in along borders between the lower surface of the frame 26, that is, the downward facing surface of the ink-permeated body 27, and the lengthwise sides 26c of the frame 26. The heat-sensitive stencil sheet 28 is then brought into intimate contact with the lengthwise sides **26*c* and fixedly adhered thereto by the adhesive on the predetermined region 50**.

In S3, the heat-sensitive stencil sheet 28 is folded in along borders between the lower surface of the frame 26 and the widthwise sides **26*b*. The heat-sensitive stencil sheet 28 is then brought into intimate contact with the widthwise sides 26*b* and fixedly adhered thereto by the adhesive of the predetermined region 50**.

Folding the heat-sensitive stencil sheet 28 against the widthwise sides **26*b* produces the fold-in flaps A from two triangular overlapping layers of the heat-sensitive stencil sheet 28. The layers are adhered at their inner surfaces by the adhesive of the predetermined region 50, thereby preventing ink of the ink-permeated body 27 from flowing out from between the layers of the fold-in flaps A. Each fold-in flap A is in contact with a vertical edge of the frame 26, that is, with an edge on the border between one of the lengthwise sides 26***c* and one of the widthwise sides 26*b*. A corresponding portion of the adhesive on the predetermined region 50 is exposed through the through holes 51.

Figure 7:
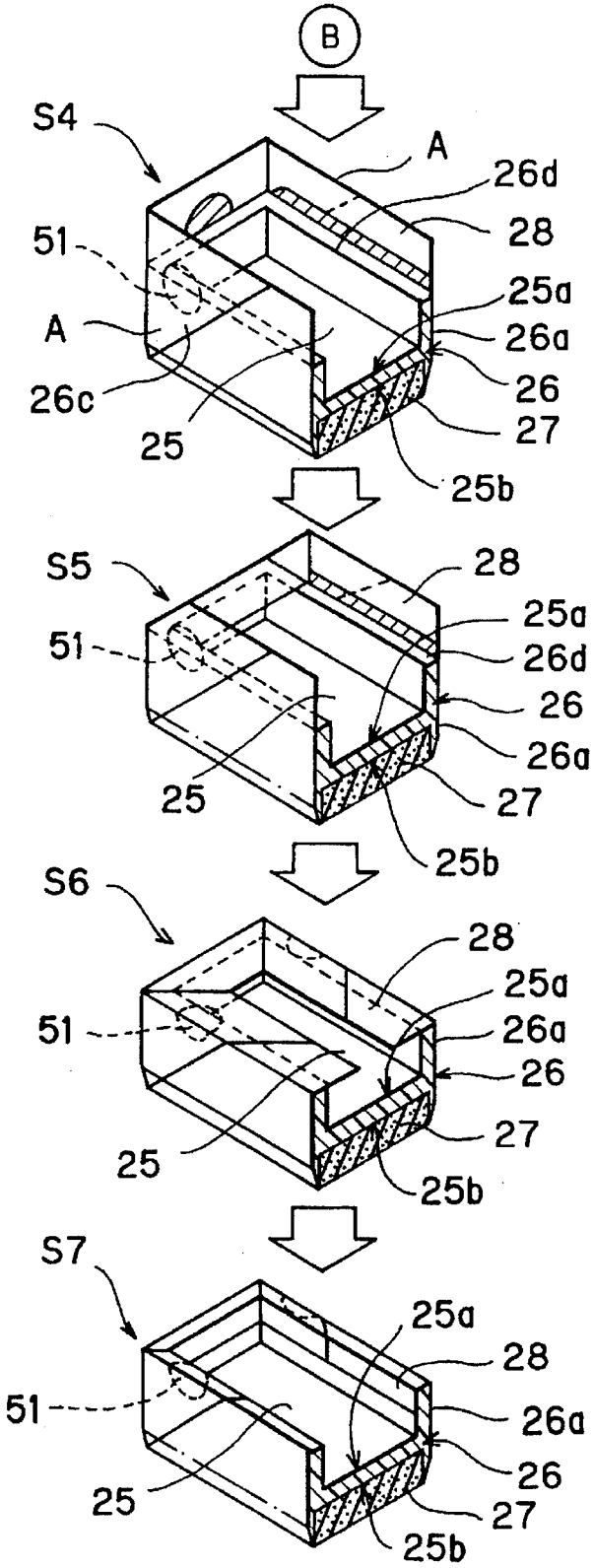
FIG. 7 is a perspective cross-sectional view taken along line X—X of FIG. 4 and illustrating another portion of steps for assembling the stamp cartridge.

Moving on to FIG. 7, in S4 the fold-in flaps A are folded in along vertical edges of the frame 26. The fold-in flaps A are then attached to the lengthwise sides 26*c* by the adhesive exposed through the through holes 51. In this way, it is possible to temporarily fix the fold-in flaps A to the lengthwise sides 26*c* without again applying adhesive, thereby facilitating and simplifying the processes for fixing the heat-sensitive stencil sheet 28 to the frame 26. As will be described later in S6 and S7, this also makes it possible to easily and reliably fold in and attach the fold-in flaps A to the inner surface of the recessed portion 25*a*. In addition, since ink no longer seeps into the portions having adhesive adhering the heat-sensitive stencil sheet 28 to the peripheral wall 26*a*, it is possible to prevent the leakage of ink to the outside of the stamp cartridge 4 in every respect.

Next, in S5 the heat-sensitive stencil sheet 28 is folded in along borders between the upper edge 26*d* and the widthwise sides 26*b* and then adhered and fixed to the widthwise upper edges of the frame 26 by the adhesive of the predetermined region 50.

In S6, the heat-sensitive stencil sheet 28 (including the fold-in flaps A) is folded in along borders between the upper edge 26*d* and the lengthwise sides 26*c* and then adhered and fixed to the upper edge 26*d* by the adhesive of the predetermined region 50.

Fixing the heat-sensitive stencil sheet 28 to the upper edge 26*d* in S5 and S6 results in the heat-sensitive stencil sheet 28 being folded at right angles at borders between the upper edge 26*d* and the peripheral wall 26*a*, that is, both the lengthwise sides 26*c* and the widthwise sides 26*b*, of the frame 26.

Next, in S7 the heat-sensitive stencil sheet 28 (including the fold-in flaps A) is folded over the upper edge 26*d* and into the recessed portion 25*a*. The heat-sensitive stencil sheet 28 is then brought into contact with the inner surface of the recessed portion 25*a*. This completes the process of covering the frame 26 with the heat-sensitive stencil sheet 28 and fixing the heat-sensitive stencil sheet 28 to the frame 26.

At this point, the heat-sensitive stencil sheet 28 passes over the upper edge 26*d* of the peripheral wall 26*a* of the frame 26 and is folded into the inner side of the peripheral wall 26*a*. Consequently, for ink to leak out of the stamp cartridge 4, the ink must travel from the ink-permeated body 27 upwards between the heat-sensitive stencil sheet 28 and the peripheral wall 26*a* of the frame 26 and then downward into the inner side of the peripheral wall 26*a*. Leaks to the outside of the stamp cartridge 4 can be reliably prevented because the distance the ink must travel is lengthened by the length of the heat-sensitive stencil sheet 28 folded into the inner side of the peripheral wall 26*a*. The print face portion 33 will not be stained by leaking ink. Also, clear characters or patterns can be clearly stamp printed over a long period of time without the characters or patterns printed becoming stained. Further, the stamp cartridge 4 can be replaced without staining the fingers of the operator.

Also, the heat-sensitive stencil sheet 28 is attached to the peripheral wall 26*a* by the adhesive so ink will not seep between the peripheral wall 26*a* and the heat-sensitive stencil sheet 28. This further prevents ink from leaking out of the stamp cartridge.

Next, the outer-periphery holding member 5 for preventing ink leaks when the stamp cartridge 4 is inserted into the outer-periphery holding member 5 will be described while referring to FIGS. 8 (*a*) and 8 (*b*).

Figure 8:
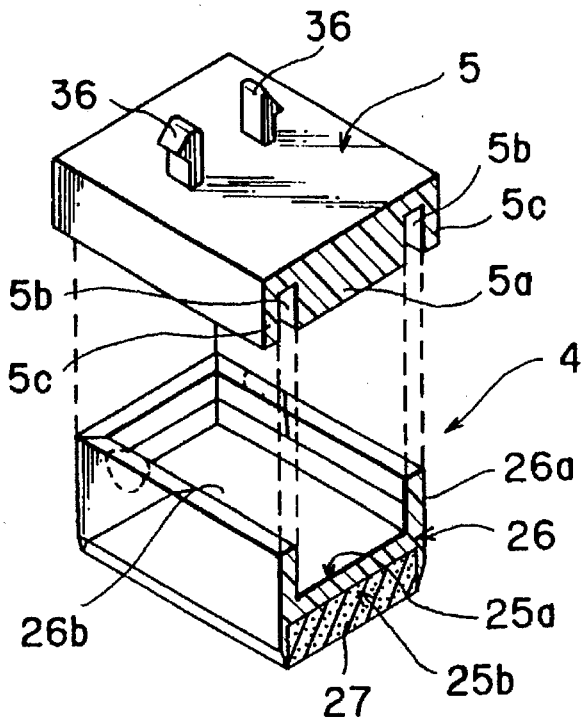
FIG. 8 (*a*) is an exploded perspective cross-sectional view showing connection between the stamp cartridge and an outer-periphery holding member according to the present embodiment.
Figure 8:
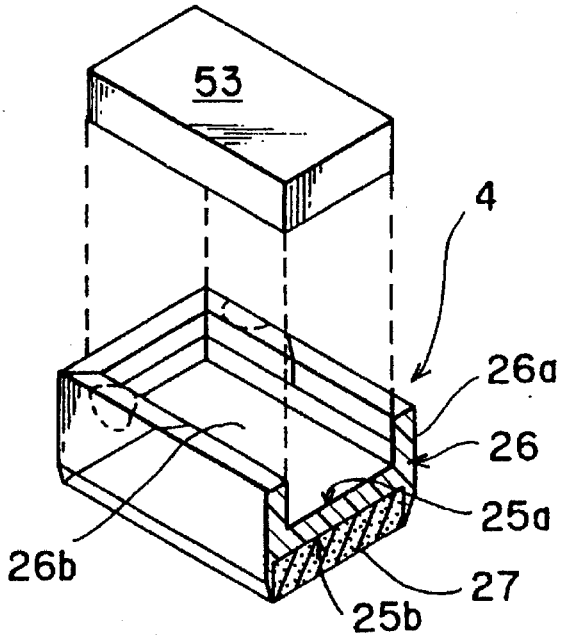

As shown in FIG. 8 (*a*), two grooves 5*b* are formed into the outer-periphery holding member 5, thereby forming cap member 5*a* between the grooves 5*b* and a flange 5*c* surrounding the cap member 5*a*. The peripheral wall 26*a* of the frame 26 is inserted into these grooves 5*b* while the cap member 5*a* is fitted into the recessed portion 25*a*. In this manner, the flange 5*c* and the cap member 5*a* engage the peripheral wall 26*a*. The heat-sensitive stencil sheet 28 folded into the interior of the recessed portion 25*a* is held down in place by the cap member 5*a*. The flange 5*c* clamps the folded-in portion of the heat-sensitive stencil sheet 28 between the cap member 5*a* and the frame 26 so that no gaps through which ink can travel will not open between the heat-sensitive stencil sheet 28 and the frame 26. Therefore, ink seeping from the ink-permeated body 27 is stopped up by the folded-in portion of the heat-sensitive stencil sheet 28, thereby completely eliminating leakage of ink from the folded-in portion to outside the stamp cartridge 4.

FIG. 8 (*b*) shows another example of the stamp member 3, the cap member 53 made from an ink-absorbable material such as felt is fitted into the upper surface recessed portion 25*a* of the frame 26. The cap member 53 also presses the heat-sensitive stencil sheet 28 against the interior of the recessed portion 25*a* so that ink is prevented from leaking. Further, even if for some reason the ink unexpectedly leaks from the folded-in portion of the heat-sensitive stencil sheet 28, then the leaked ink will be absorbed by the felt in the cap member 53. Therefore, in every respect, these measures can provide sure prevention against leakage of the ink to the outside of the stamp cartridge. It should be noted that the cap member 53 eliminates the need to form the grooves 5*b* of the outer-periphery holding member 5. Also, the outer-periphery holding member 5 shown in FIG. 8 (*a*) could also include ink-absorbable material for absorbing ink which might seep up from the ink-permeated body 27.

While the invention has been described in detail with reference to specific embodiments thereof, it would be apparent to those skilled in the art that various changes and modifications may be made therein without departing from the spirit of the invention, the scope of which is defined by the attached claims.

For example, in the above embodiment, the fold-in flaps A are attached to the lengthwise sides 26*c* of the frame 26 and afterward brought into contact with the inner surface of the upper surface side recessed portion 25*a* of the frame 26. However, it is evident that the same results of the above embodiment can be attained by a stamp cartridge 4 having the predetermined region 50 and through holes 51 provided in the heat-sensitive stencil sheet 28 so that the fold-in flaps A are attached to the widthwise sides 26*b* of the frame 26 and then afterward brought into contact with the inner surface of the recessed portion 25*a*.

What is claimed:

1. A stamp cartridge, comprising:

a frame having a plate and a peripheral wall together defining a first recess to a first side of the plate and a second recess to a second side of the plate;

an ink-permeated body disposed in the second recess so that a surface of the ink-permeated body is framed by the peripheral wall;

a heat-sensitive stencil sheet covering the framed surface of the ink-permeated body and an outer periphery of the peripheral wall, a portion of said heat-sensitive stencil sheet folding into the first recess; and an adhesive layer coated to a selected region of said heat-sensitive stencil sheet, said heat-sensitive stencil sheet having a through hole formed therein at a position outside of and adjacent to the selected region which can be folded so that an adhesive portion of said adhesive layer on said heat-sensitive stencil sheet is exposed through the through hole, and wherein the exposed adhesive portion adheres a flap portion of said heat-sensitive stencil sheet to said heat-sensitive stencil sheet in contact with the peripheral wall.

2. A stamp cartridge as claimed in claim 1, further comprising a cap member fitted in the first recess to press the portion of said heat-sensitive stencil folded into the first recess against an inner surface of the peripheral wall.

3. A stamp cartridge as claimed in claim 2, wherein the cap member includes ink-absorbable material.

4. A stamp cartridge as claimed in claim 3, wherein the ink-absorbable material includes felt.

5. A stamp cartridge as claimed in claim 2, wherein the cap member has a shape which substantially corresponds to a shape of the first recess portion.

6. A stamp cartridge as claimed in claim 5, further comprising a flange connected with said cap member, said flange and said cap engaging with the peripheral wall.

7. A stamp cartridge as claimed in claim 1, wherein the predetermined region includes at least a surface of said heat-sensitive stencil sheet in contact with the peripheral wall and does not include a surface of said heat-sensitive stencil sheet in contact with the framed surface of said ink-permeated body.

8. A stamp cartridge as claimed in claim 1, further comprising a cap member fitted in the first recess to press a portion of said heat-sensitive stencil folded into the first recess against an inner surface of the peripheral wall.

9. A method of assembling a stamp cartridge including a frame having a plate and a peripheral wall together defining a first recess to a first side of the plate and a second recess to a second side of the plate, the method comprising the steps of:

inserting an ink-permeated body into the second recess of the frame so that a surface of the ink-permeated body is framed by the peripheral wall;

coating a selected region of a heat-sensitive stencil sheet with an adhesive layer;

forming a through hole in the heat-sensitive stencil sheet at a position outside of and adjacent to the selected region;

covering the framed surface of the ink-permeated body and an outer periphery of the peripheral wall with the heat-sensitive stencil sheet whereby the selected region includes at least a surface of the heat-sensitive stencil sheet in contact with the peripheral wall and excludes a surface of the heat-sensitive stencil sheet in contact with the framed surface of the ink-permeated body;

folding an edge portion of the heat-sensitive stencil sheet into the first recess so that an adhesive portion of the adhesive layer on the heat-sensitive stencil sheet is exposed through the through hole; and adhering a flap portion of said heat-sensitive stencil sheet to said heat-sensitive stencil sheet in contact with the peripheral wall using the exposed adhesive portion.

10. A method of assembling a stamp cartridge as claimed in claim 9, further comprising step of fitting a cap member into the first recess to press the edge portion of said heat-sensitive stencil folded into the first recess against an inner surface of the peripheral wall.

* * * * *

UNITED STATES PATENT AND TRADEMARK OFFICE

CERTIFICATE OF CORRECTION

PATENT NO. : 5,647,273

DATED : July 15, 1997

INVENTOR(S) : Teruo IMAMAKI

It is certified that error appears in the above-indentified patent and that said Letters Patent is hereby corrected as shown below:

On the title page:

[75] Inventor: Please change "Ksugai" to --Kasugai--.

Signed and Sealed this

Twenty-eighth Day of October, 1997

*Attest:*

Bruce Lehman

BRUCE LEHMAN

*Attesting Officer*

*Commissioner of Patents and Trademarks*